US010753108B2

(12) United States Patent
Baum

(10) Patent No.: US 10,753,108 B2
(45) Date of Patent: Aug. 25, 2020

(54) POWER ASSISTED STRIPPING CORNER FOR FORMING CONCRETE WALLS

(71) Applicant: Norton Baum, Gilberts, IL (US)

(72) Inventor: Norton Baum, Gilberts, IL (US)

(73) Assignee: Forming Concepts, Inc., Gilberts, IL (US)

( * ) Notice: Subject to any disclaimer, the term of this patent is extended or adjusted under 35 U.S.C. 154(b) by 189 days.

(21) Appl. No.: 15/822,931

(22) Filed: Nov. 27, 2017

(65) Prior Publication Data

US 2018/0313098 A1 Nov. 1, 2018

Related U.S. Application Data

(60) Provisional application No. 62/490,181, filed on Apr. 26, 2017.

(51) Int. Cl.
*E04G 11/08* (2006.01)
*E04G 17/00* (2006.01)

(52) U.S. Cl.
CPC ..... *E04G 11/082* (2013.01); *E04G 17/001* (2013.01)

(58) Field of Classification Search
CPC ..... E04G 11/082; E04G 9/08; E04G 15/063; E04G 15/065; E04G 13/02
USPC ..... 425/468; 249/36, 37, 178, 180, 48, 50, 249/51
See application file for complete search history.

(56) References Cited

U.S. PATENT DOCUMENTS 950,827 A * 3/1910 Smith ..... B28B 7/22 249/185
3,476,351 A * 11/1969 Burdett ..... B28B 7/30 249/82
3,844,526 A * 10/1974 McCracken ..... B28B 7/30 249/152
4,055,321 A * 10/1977 Schimmel ..... B28B 7/22 249/182
4,418,884 A * 12/1983 Schimmel ..... E04G 11/02 249/11
4,519,570 A * 5/1985 Strickland ..... E04G 11/082 249/180
4,520,988 A * 6/1985 Walker ..... E04G 11/082 249/13
4,520,989 A * 6/1985 Digh ..... E04G 11/082 249/13
5,230,907 A * 7/1993 Strickland ..... E04G 11/082 249/161
5,788,874 A * 8/1998 Tucker, Jr. ..... B28B 7/0011 16/221
8,733,727 B2 * 5/2014 Vanagan ..... E04G 17/001 249/36

FOREIGN PATENT DOCUMENTS

CH 450686 A * 1/1968 ..... E04G 11/02
FR 2036750 A1 * 12/1970 ..... E04G 11/082
FR 2040187 A6 * 1/1971 ..... E04G 11/02
FR 2514394 A1 * 4/1983 ..... B28B 7/30

* cited by examiner

*Primary Examiner* — Michael Safavi
(74) *Attorney, Agent, or Firm* — Erickson Law Group, PC

(57) ABSTRACT

A stripping corner for an inside form, such as for forming the inside corner of an elevator core in building construction for pouring concrete, is provided that includes a powered actuator that forcibly collapses the perimeter of the inside form, particularly the inside corners of the form, to allow displacement of the inside form from the formed concrete surface to strip the inside form from the concrete.

14 Claims, 6 Drawing Sheets

POWER ASSISTED STRIPPING CORNER FOR FORMING CONCRETE WALLS

This application claims the benefit of U.S. Provisional Application No. 62/490,181 filed Apr. 26, 2017.

BACKGROUND

When concrete elevator cores are built on jobsites inside corners are required. Inside forms are used to form the inside of the elevator core. Once the concrete has set the inside forms must be stripped inside the elevator core. Typically, to strip the inside form, provisions must be made to forcibly decrease the perimeter of the form to break the form from the concrete and strip the form. This is necessary in order to reuse the form at the next elevation of forming to pour another course of concrete on top of the previously poured course. A self-lifting form, such as described in U.S. Pat. Nos. 9,611,663; 9,279,260 and/or 8,020,271 is used to move the inside form up the elevator core. These patents are herein incorporated by reference. In this way, the elevator core is cast course-by-course from a lowest elevation to a highest elevation, to complete the elevator core for the building.

One of the present design inside corners for self-lifting forms involves the use of a steel inside corner approximately 7"×7". This inside corner is bolted to the adjacent form panel with an approximately ½" thick rubber spacer. In order to strip this corner there are plates welded to the steel channel walers that meet at the inside corner.

These plates have two sets of holes through them, one set that overlaps (i.e., not precisely aligned or registered) and another set that is aligned. In order for the corner to strip away from the formed concrete, a tapered pin is driven out of the aligned set of holes and into the overlapping holes. This causes the overlapping holes to come into alignment. When the overlapping holes are aligned, the steel corner is caused to bend and flex. The rubber spacer also compresses on one edge. This causes the corner to collapse enough to allow the corner form to strip and the formwork to be raised.

In order to strip and reset the present design corner, a workman with a large hammer must climb up the formwork. The formwork may be as high as 18 feet. There are up to four different locations, at different elevations, where the driving of pins must be done in each corner. Once tied off at a location the workman must drive out a pin that is in the aligned position hole and re-drive the pin into the overlapping holes. Once this is done at all the corner locations the form can be raised. Once the form is raised to the next course, the workman once again must climb the formwork at all the pinning locations, drive the pin out of the overlapping hole or stripped position and then re-drive the pin into the aligned holes corresponding to the set position for forming and pouring concrete.

The present inventor has recognized that this must occur at all the pinning locations in all the corners. This involves significant climbing and work by workmen, and cost, to accomplish the task.

SUMMARY

The exemplary embodiment of the present invention provides a stripping corner for an inside form that includes a powered actuator that forcibly collapses the perimeter of the inside form, particularly the inside corners of the form, to allow displacement of the inside form from the formed concrete surface.

The use of the exemplary embodiment inside form with power assisted stripping is advantageous for pouring elevator cores. However, the inside form with power assisted stripping can be used for other forming situations and forming applications as well, particularly when a rectangular inside perimeter is being formed.

In the exemplary embodiment of the present invention the driving of pins at all locations are eliminated. The overlapping and aligned holes formerly used in the corner plates are replaced with a long slot. A loose bolt or pin is inserted in this slot for alignment. This also controls the amount of travel of the corner. A mechanical device such as a hydraulic cylinder or an electrical actuator is installed at various locations at an angle across each corner, i.e., diagonally. All of the mechanical devices are operated together and are actuated by a switch or valve.

When the form is ready to be stripped a workman standing on a work platform activates the mechanical devices which retract and the form is stripped from the inside concrete surfaces. When ready to be reset the workman again standing in a single location, and not climbing, activates the mechanical device in the opposite direction thereby resetting the form at the proper set position to pour concrete. The retracting at each corner, and at each elevation, is no longer done by the insertion of a tapered pin but by the retracting of a mechanical device.

The embodiment of the invention eliminates the need for climbing the formwork by workman. This climbing was previously done twice at each floor pour. On a large 40 story building this function had to be performed 80 times at each corner. There could be as much as 12 or 14 corners on a project, meaning 1120 times climbing by a workman was required. With the embodiment of the invention climbing is eliminated. The embodiment of the invention saves large amounts of expensive jobsite labor and eliminates the time consuming climbing function.

Numerous other advantages and features of the present invention will be become readily apparent from the following detailed description of the invention and the embodiments thereof, and from the accompanying drawings.

DETAILED DESCRIPTION

Figure 1:
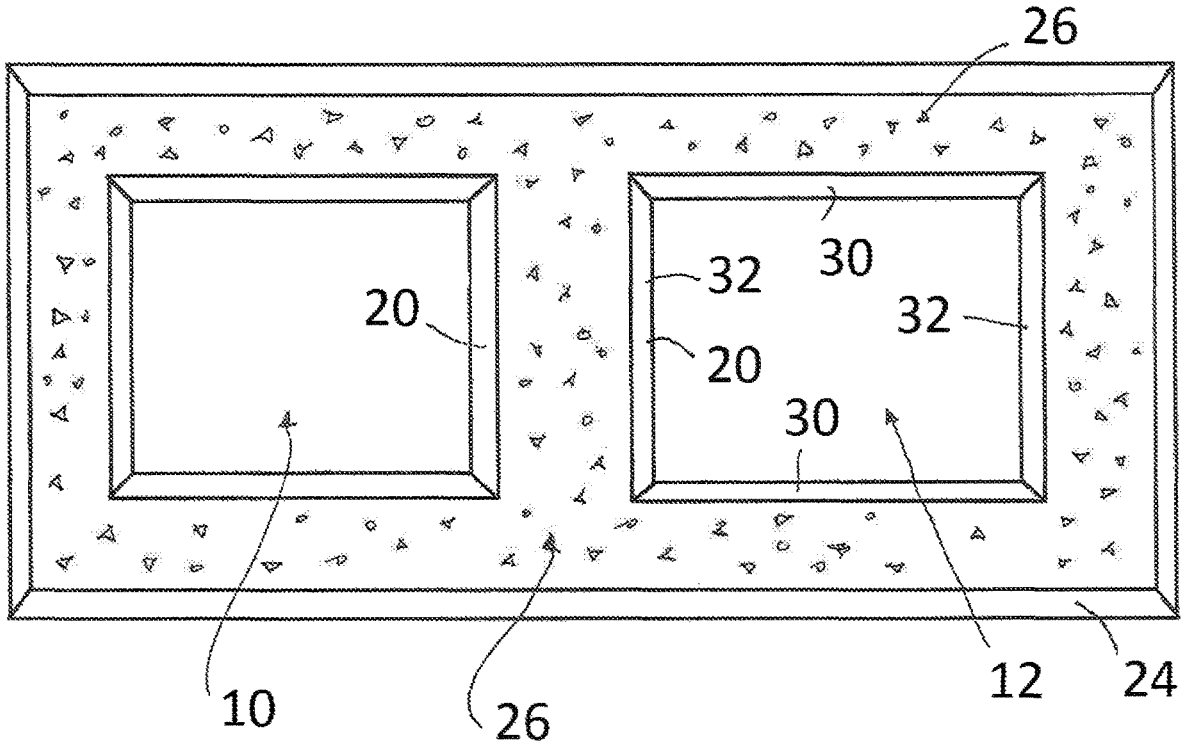
FIG. 1 is a schematic view of two elevator shafts under construction including an outside form and an inside form for pouring concrete walls.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

U.S. Pat. Nos. 9,611,663; 9,279,260 and 8,020,271 are herein incorporated by reference. U.S. Provisional Application No. 62/490,181 filed Apr. 26, 2017 is also herein incorporated by reference.

FIG. 1 shows two basic elevator shafts 10, 12 under construction. For each shaft 10, 12 a rectangular inside form 20 is spaced from, and located inside of, a rectangular outside form 24. The volume between the forms 20, 24 determines the walls thickness of the elevator shafts. This volume contains appropriate steel reinforcing or rebar and is filled with concrete 26 to form the elevator shafts 10, 12.

Figure 3:
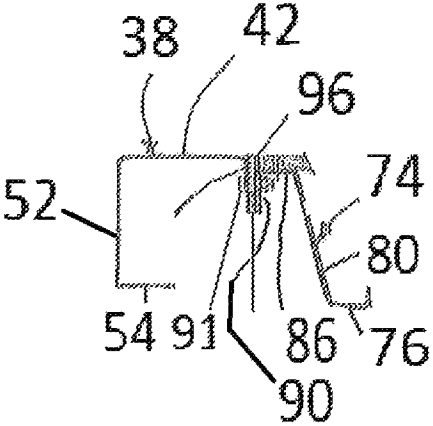
FIG. 3 is an enlarged fragmentary plan view of a portion of the corner shown in FIG. 2.
Figure 2:
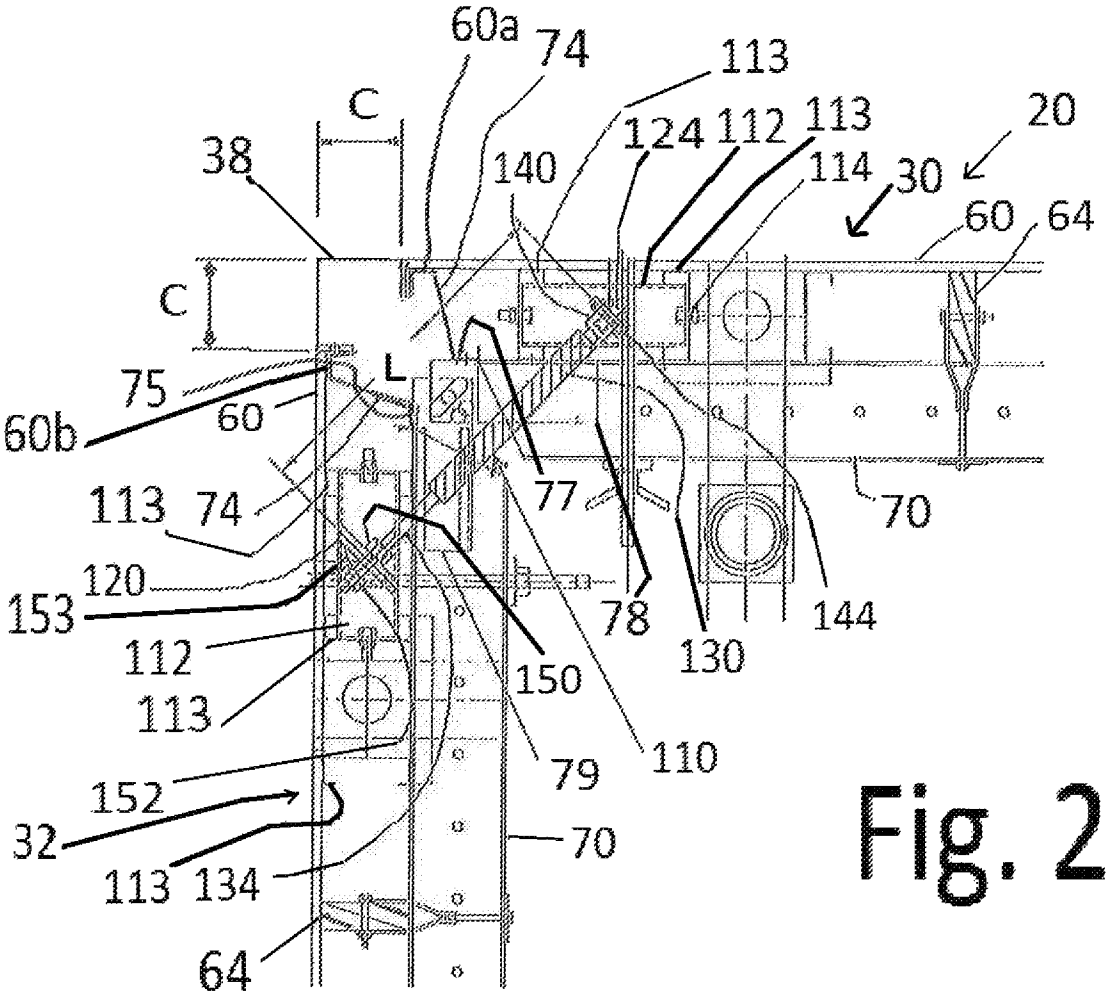
FIG. 2 is an enlarged fragmentary plan view of a corner of the inside form as shown in FIG. 1.

FIGS. 2 and 3 illustrate the construction of the inside form 20 in more detail. Only one corner is shown with the understanding that all or some of the corners of the form 20 can be arranged in the same way. The form includes a first wall 30 and a second wall 32 at a right angle to the first wall 30. The first and second walls 30, 32 are connected together by a corner piece 38. The corner piece 38 includes a first leg 42 with a perpendicular bent off or turned flange 44, and a second leg 52 with a bent off or turned flange 54. The legs 42, 52 can have a length C of about 7 inches.

Each wall includes a forming panel 60, such as a plywood panel, attached to vertical studs 64 which are attached to horizontal inside beams or walers 70. Additionally, each wall includes a Z-shaped corner stud 74. The Z-shaped corner stud 74 has a base leg 76 attached to a corner plate 78 or 79 by fasteners or welding at 75 or 77, which are attached to the beam 70. The base leg 76 is connected to an angled leg 80 which is angled toward the corner piece 38. The leg 80 is connected to a distal leg 86 which is connected to a flange 90 at a right angle thereto. The distal leg 86 is fastened to the forming panel at 60*a* or 60*b*. The flange 90 is parallel to and closely spaced from the corresponding flange 44 or 54 of the corner piece 38. A flexible or elastomeric spacer 96 is located between the flange 90 and the corresponding flange 44 or 54. The flange 90 and the corresponding flange 44 or 54 and the rubber spacer 96 have holes that register for receiving a fastener 91 which clamps the rubber spacer 96 between the flange is 90, 44 or 54 and attaches the corner piece to the corresponding wall. Multiple fasteners 91 are spaced-apart along the height of the flange 90, i.e., into the page of FIG. 3.

Figure 4:
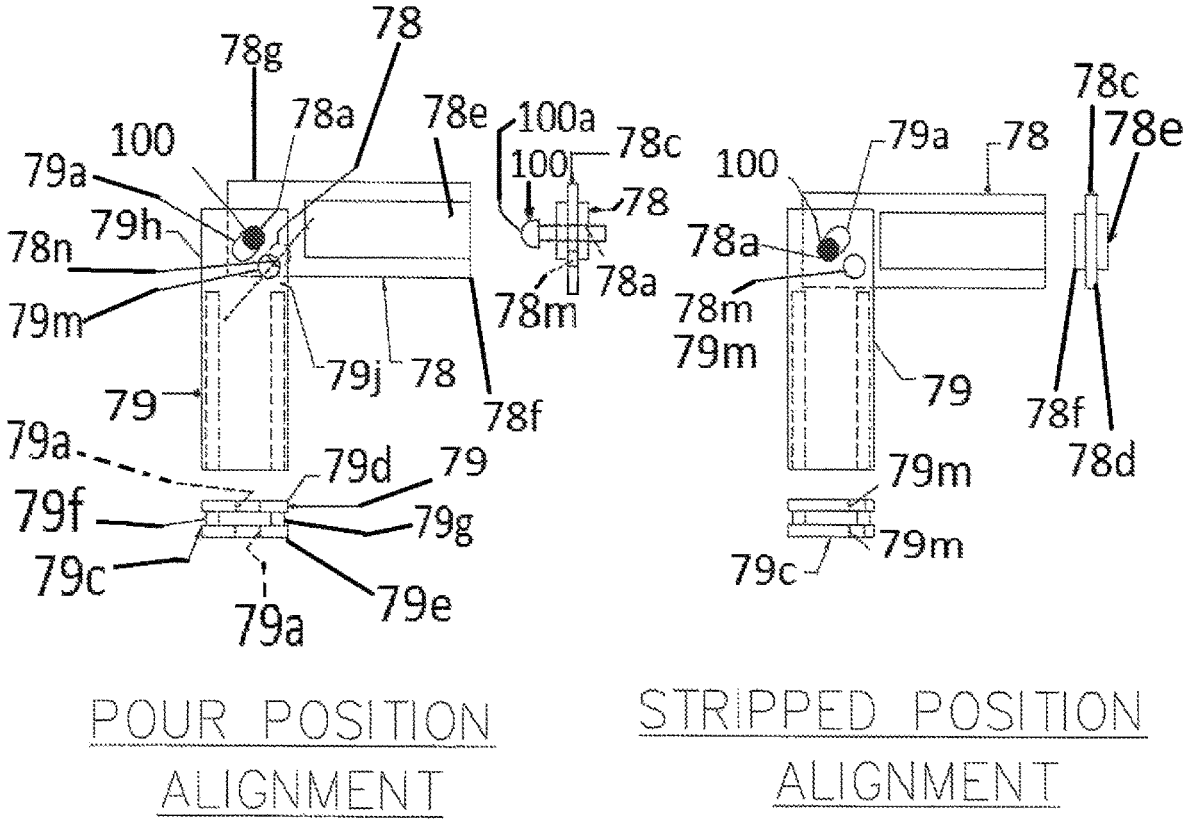
FIG. 4 is a schematic view comparing the pour position alignment of the corner and the stripped position alignment of the corner.

As shown in FIG. 4, the first corner plate 78 of the first wall is connected to a second corner plate 79 of the second wall by a pin 100 that is somewhat loosely fit into a hole 78*a* through the first corner plate 78 and somewhat loosely fit into a diagonal slot 79*a* through the corner plate 79. The pin 100 can include a head 100*a* which is omitted in the plan views in FIG. 4 to show the underlying slot. It is also possible that the pin 100 is fixed into the hole 78*a* in the first corner plate 78. The hole 78*a* and the pin 100 register with the slot 79*a*. The hole 78*a* and the slot 79*a* are arranged in overlapping end regions 78*g*, 79*h* of the first and second corner plates 78, 79, respectively. The slots 78*a*, 79*a* allow for collapsing movement of the corner as the corner plates 78, 79 further overlap by moving along a diagonal path.

As a further enhancement of the embodiment, a manual arrangement is provided to move the corner plates from the pour position (form walls 30, 32 being in the forming position) to the stripped position (form walls 30, 32 retracted from the finished concrete walls) as shown in FIG. 4. The corner plate 78 includes a first positioning hole 78*m* and the second corner plate has a second positioning hole 79*m*. In the pour position the holes are offset but partially overlapping providing a registering area 78*n*. The axes of the holes 78*m*, 79*m* (into the page) are arranged on a 45 degree line 79*q*, parallel to the lengthwise axis of the slot 79*a* and parallel to the relative collapsing movement of the two corner plates 78, 79 when moving from the pour position to the stripped position. When a tapered pin is driven into the area 78*n* the holes are forcibly aligned which drives the corner plates 78, 79 relative to each other along the line 79*q* from the pour position to the stripped position.

The first wall 30 and the second wall 32 are also connected together by an actuator 110. Each of the first and the second walls includes a horizontal plate or channel 112 having end plates connected to adjacent studs 113 by fasteners 114. A diagonal plate 120 is welded to the channel 112 on the second wall 32. On the first wall 30, instead of a diagonal plate, a diagonal lug 124 is welded to the channel 112.

The actuator 110 is arranged diagonally across the corner between the two walls. The actuator includes a body 130 and an extendable shaft 134. The shaft 134 either moves into or out of the body 130 to lengthen or contract the actuator length L, depending on the actuation instruction given to the actuator 110. The body 130 includes a yoke 140 that is connected by a fastener 144 to the lug 124. The extendable shaft 134 can be threaded at the end thereof, and then attached to the diagonal plate by opposing nuts 150, 152 and a battered washer or spring washer 153. The actuator length can be about 2-3 feet long, advantageously 2.4 feet. Advantageously, each corner has plural actuators arranged spaced apart along the height of the walls 30, 32 (into the page of FIG. 2), such as 2, 3, 4 or other number for a one story pour, or such as one every 6 feet or so of vertical height.

FIG. 2 shows the corner in the pour position alignment. After the concrete pour has cured sufficiently, the inside form is stripped from the concrete and then raised to a next level or course for forming a continuation of the elevator shaft on top of the previously poured course. In this regard, the actuator 110 is contracted at each corner of the inside form 20 which deforms the elastomeric spacer 96 slightly and deflects the legs 42, 52 of the corner piece 38 slightly together as the two walls 30, 32 are moved inwardly while the pin and the slots 78*a*, 79*a* allow the corner plates 78, 79 to overlap to a slightly greater extent. This is enough movement to strip the plywood panels 60 slightly away from the concrete to be thereafter vertically displaceable from the formed concrete, to form the next level.

FIG. 4 illustrates in schematic fashion the movement of the corner plates 78, 79 to slightly further overlap with the pin and slot accommodating this movement. The plate 78 has an end profile 78*c* and the plate 79 has the end profile 79*c*. The profile 78*c* includes a middle plate 78*d* reinforced by upper and lower plates 78*e*, 78*f*. The plate has an end region 78*g* that only has the middle plate 78*d*. The profile 79*c* includes an upper and lower body plates 79*d*, 79*e* spaced apart by walls 79*f*, 79*g*. An end region 79*h* is free of the walls 79*d*, 79*e*. The end regions 78*g*, 79*h* mesh together with the middle plate 78*d* fitting between the upper and lower body plates 79*d*, 79*e*. The hole 78*a*, and slot 79*a* are located in the end regions 78*g*, 79*h*. There is a slight clearance 79*j* between an edge of the middle plate 78*d* and the walls 79*f*, 79*g* which is closed when the walls are moved from the pour position to the stripped position. This slight clearance is a sufficient movement to strip the walls 30, 32 from the concrete.

The walls 30, 32 can be generally composed of steel with some wood components, such as the forming walls 60 and some studs 64. The studs 113 can be steel studs. Other materials of construction are encompassed by the invention. The flexible or elastomeric spacer 96 can be composed of rubber.

The actuator 110 can be a pneumatic cylinder, a hydraulic cylinder, an electric screw drive, a piezo electric drive, or other known linear actuator.

Figure 5:
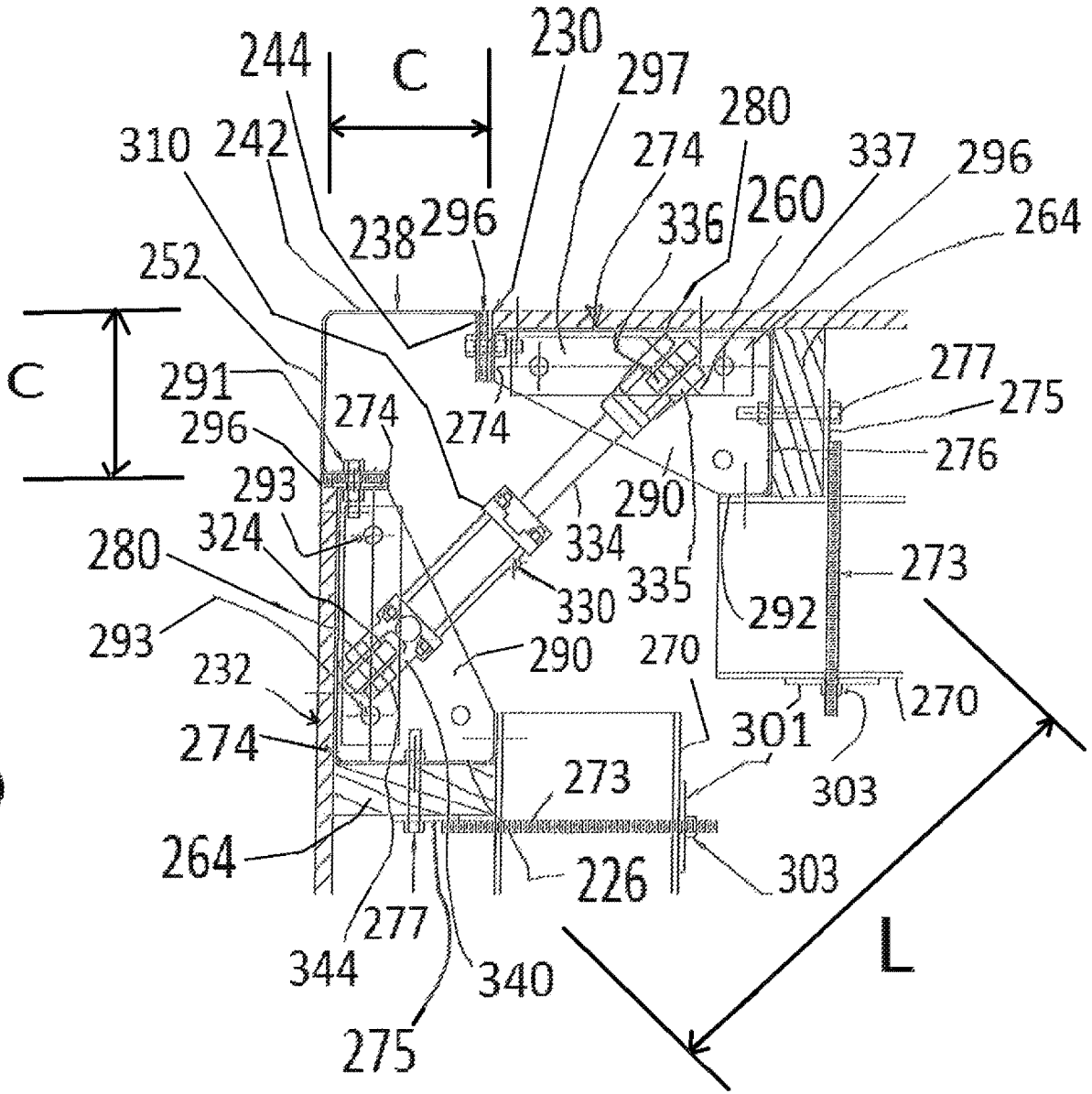
FIG. 5 is an enlarged fragmentary plan view of a corner of an inside form of an alternate embodiment.

FIGS. 5 through 11 illustrate an alternate embodiment corner of the form 20. Only one corner is shown in FIG. 5 with the understanding that all or some of the corners of the form 20 can be arranged in the same way. The form includes a first wall 230 and a second wall 232 at a right angle to the first wall 230. The first and second walls 230, 232 are connected together by a corner piece 238. The corner piece 238 includes a first leg 242 with a perpendicular bent off or turned flange 244, and a second leg 252 with a bent off or turned flange 254. The legs 242, 252 can have a length C of about 7 inches.

Each wall includes a forming panel 260, such as a plywood panel, attached to vertical studs 264 which are attached to horizontal inside beams or walers 270.

Additionally, each wall includes a generally L.-shaped corner stud 274. The L.-shaped corner stud 274 has a base leg 276 attached to a stud 264 with a fastener 277 that is surrounded by a washer 275. The base leg 276 is connected to, or continuous with, a face leg 280 that is perpendicular to the base leg 276 and flush with an inside surface of the adjacent forming panel 260. The face leg 280 is fastened to the forming panel.

A flexible or elastomeric spacer 296 is located between the flange 290, 292 (described below) and the corresponding flange 244 or 254. The flange 290, 292 and the corresponding flange 244 or 254 and the rubber spacer 296 have holes that register for receiving a fastener 291 which clamps the rubber spacer 196 between the flanges 290, 144 or 292, 254 and attaches the corner piece 238 to the respective wall. Multiple fasteners 291 are spaced-apart along the height of the flange 290, 292, i.e., into the page of FIG. 5.

The first wall 230 and the second wall 232 are also connected together by an actuator 310.

The actuator 310 is arranged diagonally across the corner between the two walls. The actuator includes a body 330 and an extendable shaft 334. The shaft 334 either moves into or out of the body 330 to lengthen or contract the actuator length L, depending on the actuation instruction given to the actuator 310. The body 330 includes a yoke 340 that is connected by a fastener 344 (not shown) to a lug 324 (described below). The extendable shaft 334 also has a yoke 335 at the end thereof, and attached to a lug 336 (described below) by fastener 337 (not shown). The actuator length can be about 2-3 feet long, advantageously 2.4 feet. Advantageously, each corner has plural actuators arranged spaced apart along the height of the walls 230, 232 (into the page of FIG. 5), such as 2, 3, 4, 5 or other number for a one story pour, or such as one every 6 feet or so of vertical height.

Figure 6:
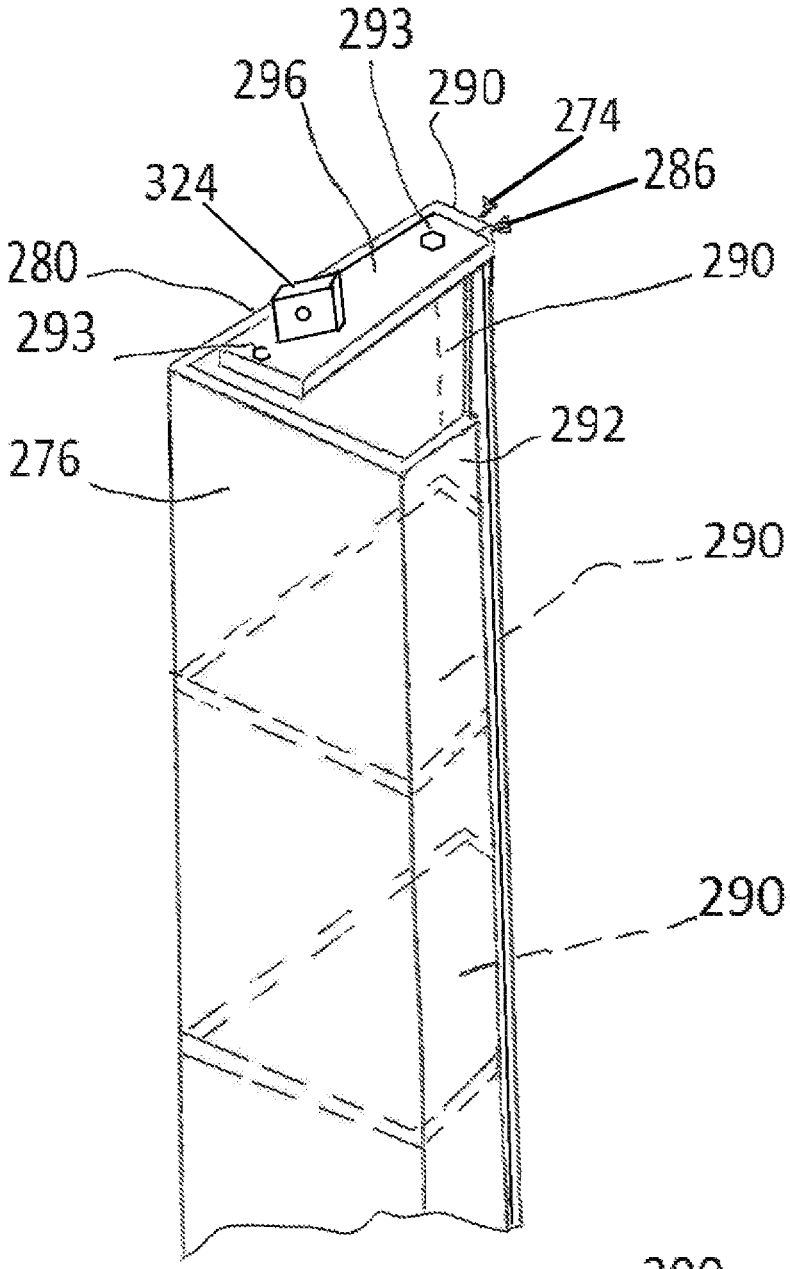
FIG. 6 is a fragmentary perspective view of a portion of the corner of the inside form shown in FIG. 5.
Figure 7:
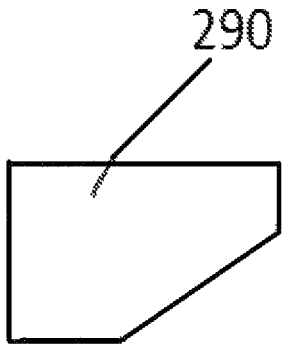
FIG. 7 is a plan view of a shaped plate taken from FIG. 6.

FIG. 6 shows one corner stud 274 in more detail. The stud 274 includes a shaped channel 286 having the generally L-shaped cross-section with the base leg 276 and the face leg 280. Near the top of the stud 274 a shaped plate 290 substantially closes the cross-section of the shaped channel 286 and is connected to the shaped channel 286, such as by welding. The face leg 280 includes the bent off or turned flange 290 and the base leg 276 includes the bent off or turned flange 292.

A bracket 296 is fixed to a top of the plate 290 by fasteners 293 or by welding. The lug 324 or the lug 326 is welded or otherwise fixed to the bracket 296.

Figure 8:
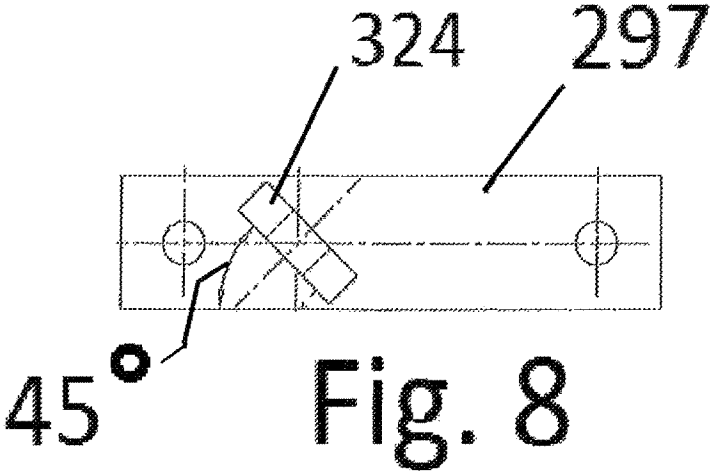
FIG. 8 is a plan view of a first bracket taken from FIG. 5.
Figure 9:
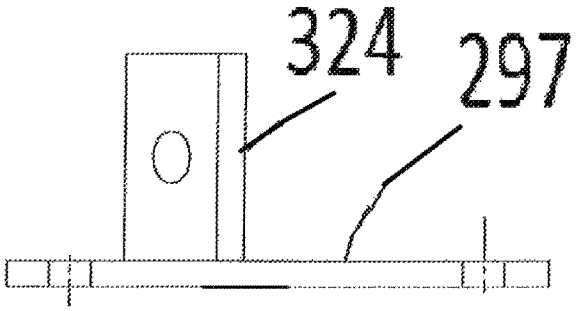
FIG. 9 is an elevation view of the bracket of FIG. 8.

FIGS. 8 and 9 illustrate the bracket 296 with the lug 324 attached thereto at a 45° angle.

Figure 10:
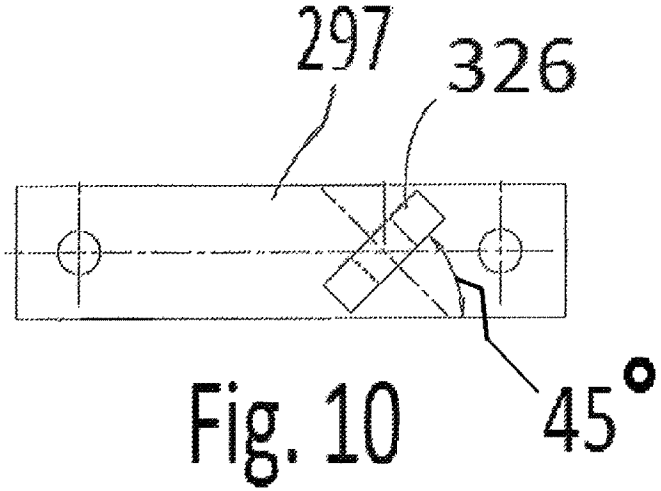
FIG. 10 is a plan view of a second bracket taken from FIG. 5.
Figure 11:
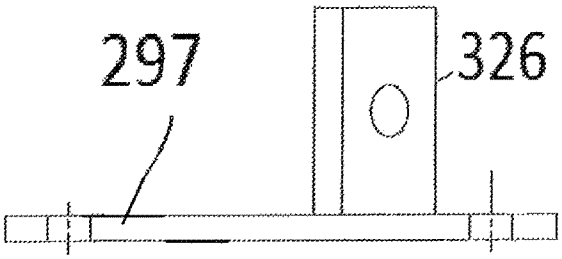
FIG. 11 is an elevation view of the bracket of FIG. 10.

FIGS. 10 and 11 illustrate the bracket 296 with the lug 326 attached thereto. The lug 326 is attached at a 45° angle and positioned to be aligned with the lug 324 diagonally across a corner of the form 20.

The walers 270 are connected to the studs 264 by elongated threaded rods 273 welded to washers 275 and retained by a washer 301 and a nut 303 against the waler. The washers 275 are fixed in place by the fasteners 277.

FIG. 5 shows the corner in the pour position alignment. After the concrete pour has cured sufficiently, the inside form is stripped from the concrete and then raised to a next level or course for forming a continuation of the elevator shaft on top of the previously poured course. In this regard, the actuator 310 is contracted at each corner of the inside form 20 which deforms the elastomeric spacer 296 slightly, and deflects the legs 242, 252 of the corner piece 238 slightly together as the two walls 230, 232 are moved inwardly. This is enough movement to strip the plywood panels 260 slightly away from the concrete to be thereafter vertically displaceable from the formed concrete, to form the next level.

The walls 230, 232 can be generally composed of steel with some wood components, such as the forming walls 160 and some studs 164. The studs 274 can be steel studs. Other materials of construction are encompassed by the invention. The flexible or elastomeric spacer 196 can be composed of rubber.

The actuator 310 can be a pneumatic cylinder, a hydraulic cylinder, an electric screw drive, a piezo electric drive, or other known linear actuator.

Although FIGS. 1-11 illustrates a sectional or plan or end view of the apparatus in only the two dimensional plane of the page, it is to be understood that some members extend into the page (the height direction), such as the shafts 10, 12, the forms 20, 24, the concrete 26, the walls 160, 260, the studs 64, 113, 264, the corner pieces 38, 238 the corner studs 74, 274, the spacers 96, 296, and that other members represents not only one member in the plane of the page but a column of like members spaced-apart, in appropriate spacing into the page, such as the plates or lugs 78, 79, 112, 120, 290, 297, 324, 326, the actuators 210, 310, the fasteners 114, 91, 291, 273, 277 and the walers 70, 270.

Although various connections are described herein as by fasteners or by welding, the connections are not limited to those methods, and other known connections can be used.

From the foregoing, it will be observed that numerous variations and modifications may be effected without departing from the spirit and scope of the invention. It is to be understood that no limitation with respect to the specific apparatus illustrated herein is intended or should be inferred.

I claim as my invention:

1. A form stripping arrangement useful is stripping a rectangular inside form having four corners, comprising:

four forming walls arranged in a rectangle and forming four forming corner areas, the forming walls providing outside forming surfaces;

a plurality of flexible corner pieces, each piece connected between one pair of adjacent forming walls, and each piece sufficiently rigid to provide, by itself, a precise forming corner for forming an inside corner of formed concrete walls at one forming corner area; and a plurality of actuators, an actuator arranged between each pair of adjacent forming walls;

actuation of the actuators contracting the forming walls inwardly to decrease the perimeter of the rectangle to strip the forming surfaces from the concrete, the corner pieces flexing when the actuators are actuated to decrease the perimeter of the rectangle.

2. The arrangement according to claim 1, wherein adjacent outside forming surfaces of the four forming walls and interposed corner pieces are flush.

3. The arrangement according to claim 2, wherein the flexible corner pieces are connected to the adjacent forming walls with interposed elastomeric spacers.

4. The arrangement according to claim 3, wherein each actuator is a linear actuator and is arranged with opposite ends connected to adjacent forming walls, wherein when actuated the actuator either expands in length or contracts in length depending on the actuation instruction, and the actuator is arranged diagonally across a forming corner area.

5. The arrangement according to claim 1, wherein each corner piece is connected to an adjacent forming wall by a stud having a substantially Z-shaped cross section.

6. The arrangement according to claim 1, wherein each flexible corner piece is an elongated, shaped metal plate member.

7. The arrangement according to claim 6, wherein the elongated shaped plate member is composed of steel.

8. A form stripping arrangement, comprising:

a first forming wall for forming a first concrete wall surface;

a second forming wall for forming a second concrete wall surface and arranged at an angle to the first forming wall;

a flexible corner piece connected to and between the first and second forming walls and being sufficiently rigid to provide, by itself, a precise forming corner for forming an inside corner between the first and second concrete wall surfaces; and an actuator that is arranged between the first and second forming walls;

actuation of the actuator moving the first and second forming walls toward each other and away from the first and second concrete wall surfaces respectively, to strip the first and second forming walls from the first and second concrete wall surfaces respectively, the corner piece flexing when the actuator is actuated allowing movement of the first and second forming walls toward each other.

9. The arrangement according to claim 8, wherein each of the forming walls provides a forming surface and the corner piece is flush with the forming surfaces of the first and second forming walls.

10. The arrangement according to claim 9, wherein the flexible corner piece is connected to the first and second walls with an interposed elastomeric spacer.

11. The arrangement according to claim 10, wherein the actuator is a linear actuator and is arranged with one end connected to the first forming wall and an opposite end connected to the second forming wall, wherein when actuated the actuator either expands in length or contracts in length depending on the actuation instruction, and the actuator is arranged diagonally across the inside wall corner.

12. The arrangement according to claim 8, wherein the corner piece is connected to the first forming wall by a stud having a substantially Z-shaped cross section.

13. The arrangement according to claim 8, wherein the flexible corner piece is an elongated, shaped metal plate member.

14. The arrangement according to claim 13 wherein the elongated shaped plate member is composed of steel.

* * * * *